US006123288A

United States Patent [19]

Kenyon

[11] Patent Number: 6,123,288

[45] Date of Patent: Sep. 26, 2000

[54] APPARATUS AND METHOD FOR FLICKERLESS PROJECTION OF INFRARED SCENES

[76] Inventor: Bruce Allen Kenyon, Rte. 1 Box 573B, Sumner, Wash. 98930

[21] Appl. No.: 06/723,815

[22] Filed: Apr. 16, 1985

[51] Int. Cl.[7] ..... F41G 7/00; F41G 3/26; G01J 5/02; G09B 9/00

[52] U.S. Cl. ..... 244/3.16; 250/495.1; 250/342; 250/346; 434/4; 434/21

[58] Field of Search ..... 434/4, 21; 244/3.16; 250/495.1, 342, 346

[56] References Cited

U.S. PATENT DOCUMENTS

| | | |
|---|---|---|
| 2,979,622 | 4/1961 | Garbuny . |
| 3,080,483 | 3/1963 | Jaffe et al. . |
| 3,227,879 | 1/1966 | Blau et al. . |
| 3,229,093 | 1/1966 | Trautvetter . |
| 3,520,589 | 7/1970 | Angel et al. . |
| 3,735,137 | 5/1973 | Bly . |
| 3,743,772 | 7/1973 | Pieters et al. . |
| 3,857,042 | 12/1974 | LaGrange et al. . |
| 3,878,328 | 4/1975 | Marie et al. . |
| 4,151,421 | 4/1979 | Sumi . |
| 4,178,514 | 12/1979 | Bly . |
| 4,240,212 | 12/1980 | Marshall et al. . |
| 4,267,456 | 5/1981 | Hidai et al. . |
| 4,303,394 | 12/1981 | Berke et al. . |
| 4,572,958 | 2/1986 | Durand et al. ..... 250/495.1 |

OTHER PUBLICATIONS

Bly, "Passive visible to infrared transducer for dynamic infrared image simulation", Optical Engineering, vol. 21, No. 6 pp. 1079–1082 (Nov., Dec. 1982).

Bly, "Passive visible to infrared transducer for dynamic infrared image simulation", SPIE, vol. 226, pp. 140–148, Infrared Imaging Systems Technology (1980.

Marie et al., Single–Crystal Ferroelectrics and Their Application in Light–Value Display Devices:, lines 942–958, Preceedings of the IEE, vol. 61, No. 7 (1973.

Casasent, "E–Beam DKDP Light Valves," 344–352, Optical Engineering, vol. 17, No. 4 (Jul.–Aug. 1978).

Kingslake et al., "Applied optics and Optical Engineering," Chapter 5 (pp. 143–202, Coherent Light Valves by David Casasent, vol. VI (1980).

Salvo, "Solid–State Light Valve," 748–755, IEEE Transactions on Electron Devices, vol. Ed–18, No. 9 (Sep. 1971).

*Primary Examiner*—Stephen C. Buczinski

[57] ABSTRACT

A non-volatile electron beam-addressed light-valve produces a flickerless, all-at-once visible light output which is then converted into a flickerless projected infrared scene suitable for testing an infrared imaging seeker.

14 Claims, 5 Drawing Sheets

IMAGING IR SIMULATOR

IMAGING IR SIMULATOR

- One Hour Storage Time
- Can Change One Pixel at a Time
- Reflection Mode
- High Transfer Efficiency
- Low Signal Voltage

- Visible Image Re-emitted as IR Image
- Good Resolution (5 Cycles/mm)
- ≈ 17 Millisec Time Constant
- ΔT of 35° C Present Limit

APPARATUS AND METHOD FOR FLICKERLESS PROJECTION OF INFRARED SCENES

BACKGROUND OF THE INVENTION

This invention relates to simulation systems for testing an imaging infrared seeker, and in particular to such system for converting scene composition data stored in a digital computer into an infrared image suitable for projection to the seeker.

One type of known missile guidance system employs a seeker that extracts from the infrared images in its field of view the information upon which the missile guidance system bases its in-flight flight path corrections. The testing of such imaging infrared seekers requires an imaging infrared simulator which is capable of presenting realistic, detailed infrared images, i.e., scenes, to the field of view of the seeker. The infrared scenes presented to the seeker's field of view must simulate both the infrared characteristics of a potential missile target and the different background scenes in which the target is likely to be found.

Closed loop testing of the seeker mounted on a flight table imposes a random access requirement upon the updating of certain infrared imaging scenes. The random access requirement can be supplied by interpolation techniques of scene composition supplied by infrared imagery data stored in digital computers such that the data can be provided in streams to update the scene. To exploit this capability, however, a device must be able to convert the electronic signal of the digital computer into an infrared image suitable for projecting into the field of view of the missile seeker.

Conventional systems that have been developed to fill this need suffer from a serious difficulty known as "shading," which is a time-dependent variation in the radiation projected as the infrared scene. Shading results from serially "writing" the infrared scene data onto devices whose storage time constant approximates the scene update period. Shading affects the contrast signatures of the images of the target and the background, and a significant amount of shading causes breakdown of the simulation.

One approach involves the use of a Bly cell, such as the one described in U.S. Pat. No. 4,178,514, to convert a visible light input into an infrared light output. However, a Bly cell exhibits a relatively short time constant and therefore requires an "all-at-once" input rather than a serially written input if shading is to be avoided.

OBJECTS AND SUMMARY OF THE INVENTION

A principal object of the present invention is a method and apparatus for closed loop testing of a missile guidance system infrared seeker which converts an electronic signal into a flickerless infrared scene suitable for projection and which is also free of "shading."

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the present invention as embodied and broadly described herein, the apparatus of this invention comprises non-volatile electron beam-addressed means for producing a flickerless, "all-at-once" visible light output and means for receiving and converting this all-at-once visible light output into a flickerless projected infrared image.

The electron beam-addressed means preferably comprises a light-valve including ferroelectric birefringent crystal operating near its Curie temperature such that the charge diffusion time constant of the crystal becomes long enough to render the light valve non-volatile, i.e., inherently flickerless.

The means for receiving and converting preferably comprises a visible-to-infrared light transducer such as a Bly cell.

The accompanying drawings, which are incorporated in and constitute a part of this specification, illustrate embodiments of the invention and together with the description, serve to explain the principles of the invention.

DESCRIPTION OF THE PREFERRED EMBODIMENTS

Reference now will be made to the preferred embodiments of the invention, examples of which are illustrated in the accompanying drawings.

Figure 1:
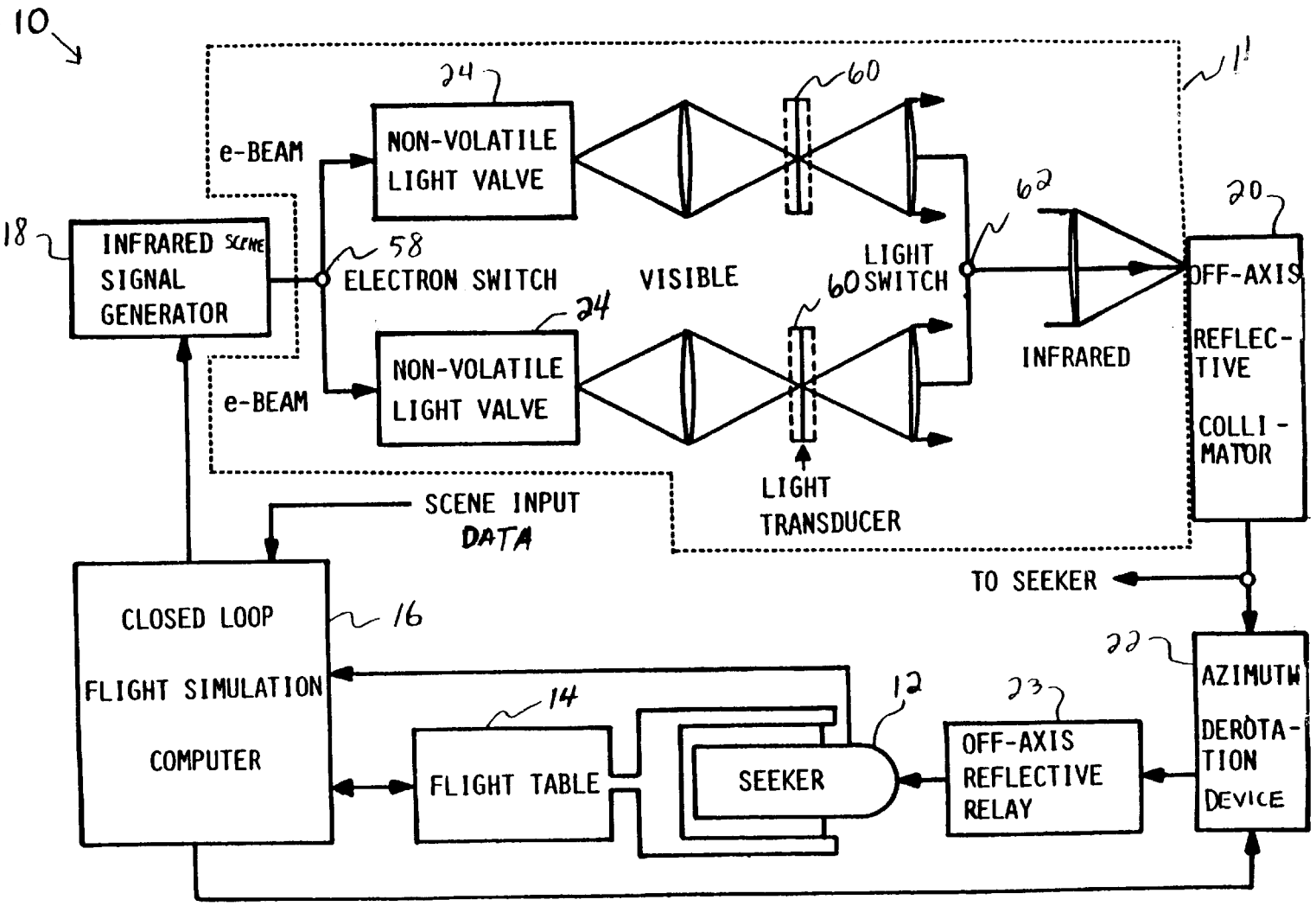
FIG. 1 is a schematic of an imaging infrared simulator which includes an embodiment of the present invention.

FIG. 1 schematically represents an imaging infrared simulator which is indicated generally by the numeral 10 and incorporates an embodiment of the present invention. A missile seeker 12 to be tested in the imaging infrared simulator is mounted on a flight table 14. The attitude of the flight table is controlled by a closed loop flight simulation computer 16 which receives information corresponding to the infrared scene to be presented to the seeker during the test of the seeker's infrared detection system (not shown).

The computer 16 sends control signals to an infrared scene signal generator 18 which generates an electrical signal corresponding to the infrared scene presented to the seeker. The signal from the infrared scene signal generator 18 is sent into electron beam-to-infrared converter 11 which is generally indicated as the portion of FIG. 1 surrounded by the broken line.

The flickerless infrared image, i.e., scene, generated as an output signal by the present invention becomes an input signal to the infrared imaging simulator's relay optics, including an off-axis reflective collimator 20, an azimuth derotation device 22 and an off-axis reflective relay 23. This infrared light signal passes through the infrared relay optics to the seeker 12. The infrared detection system (not shown) of the seeker 12 generates a response to the infrared scene presented to it, and this response constitutes a test result which is sent into the closed loop flight simulator computer 16 for evaluation or other processing. The computer 16 can also be used to control the azimuth derotation and other aspects of the infrared relay optics if desired.

In accordance with the invention, the apparatus of this invention for flickerless projection of infrared scene comprises a non-volatile electron beam-addressed means for producing a flickerless, all-at-once visible light output. The all-at-once visible light output so produced is flickerless in the sense that it remains substantially invariable over the time required to update the output as described more fully hereinafter. As embodied herein and shown schematically in FIG. 1, the electron beam-addressed means comprises a non-volatile light valve 24 such as the one developed by Marie and Donjon at Laboratoire d'Electronique Physica Applique in France and which is shown schematically in FIG. 2. This embodiment of a non-volatile light-valve (hereafter the LEP light-valve) is described in Marie et al., "Single-Crystal Ferroelectrics and Their Application in Light-Valve Display Devices," proceedings of the IEEE, Vol. 61, No. 7, pages 942–958, July 1973, which is incorporated herein by reference.

Figure 2:
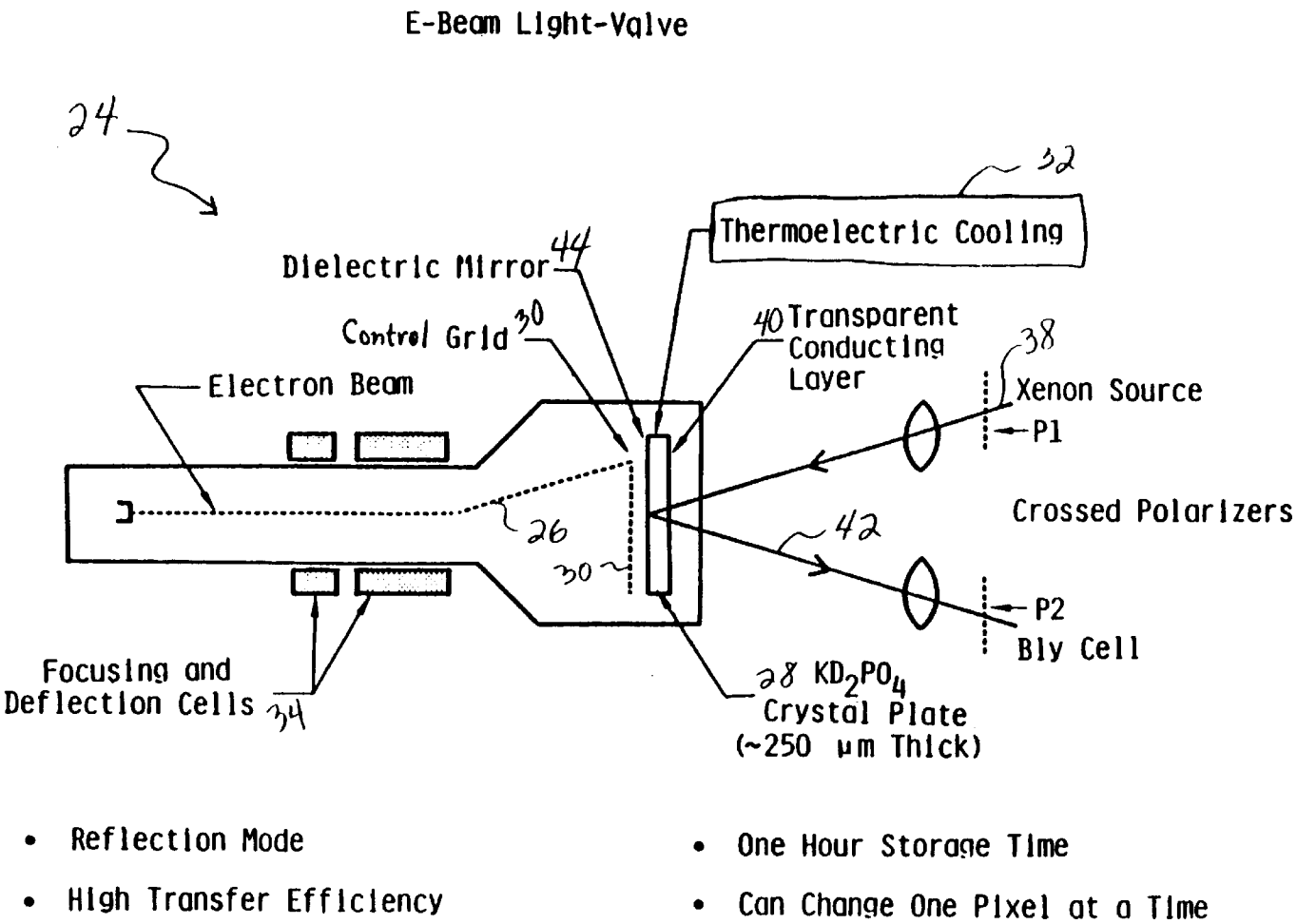
FIG. 2 is a schematic of an embodiment of a non-volatile light-valve suitable for use in the present invention.

Referring to the LEP light-valve shown schematically in FIG. 2, a scanning electron beam 26 acts as a moving short circuit between a rectangular birefringent ferroelectric crystal plate 28 and a control grid 30 closely spaced to crystal plate 28. A thermoelectric cooling device 32 shown schematically in FIG. 2 maintains crystal plate 28 at the Curie temperature of the material, such as potassium dideuterium phosphate, comprising crystal plate 28. Secondary emission from the crystal plate brings the electrical potential at the location on the crystal corresponding to the electron beam-addressed point, i.e., at the pixel, into equilibrium with the grid. A focusing and deflection device 34 focuses electron beam 26 on a single pixel as the beam is moved from one pixel to the next in a preprogrammed sequence. Only the pixel being addressed by the electron beam undergoes any change. The other pixels of the crystal retain the state achieved at the previous addressing, i.e., writing, by the electron beam. The charge deposited at each pixel does not change during the time it takes the electron beam to make two successive scans of the entire crystal, thus the LEP light-valve is inherently flickerless.

A video signal of visible light, represented schematically in FIG. 2 by a straight line 38, is polarized by polarizer P1 and impressed between the grid and a transparent conducting layer 40, also referred to as a transparent electrode, on the side of the crystal opposite the side facing the grid. As shown in FIG. 2, a polarized light beam in the visible spectrum is directed through transparent conducting layer 40 to become polarization modulated as the visible light beam passes through charged crystal plate 28. A polarization modulated light beam, represented schematically in FIG. 2 as straight line 42, is reflected from a dielectric mirror 44, which has been vacuum deposited onto the surface of crystal plate 28 facing the grid. Reflected beam 42 is modulated after passing through crystal 28. A second polarizer P2 analyzes beam 42 to effect amplitude modulation of beam 42 which then generates the infrared signal to be emitted from the transducer.

The LEP light-valve uses birefringence induced by electric fields created when charge is deposited on the face of a birefringent crystal such as potassium dideuterium phosphate (DKDP). This is described in Marie et al. at pages 948–950 and FIGS. 9 and 10 therein. In the LEP electron-beam light-valves, a spatial voltage distribution is deposited across the target crystal by the scanning electron beam. This voltage distribution is translated into a spatial light modulation through the linear, longitudinal, electro-optical effect where the voltage induces birefringence in the crystal so that a properly oriented polarized input light beam is converted into an elliptically polarized output light beam. Subsequent passage through an analyzer completes the transition to amplitude modulation of the light beam.

LEP light-valves exhibit a high ratio of light leaving the valve relative to the light incident on the valve (also known as the Maximum Readout Transfer Ratio, MRTR). These electron beam devices are characterized by readout transfer ratios of 70%. On application of a voltage to the crystal, the change in propagation speed is proportional to the electric field strength and thus propagation speed depends upon the applied voltage and the dielectric constant. The change in propagation speed is independent of crystal length and almost independent of wavelength. A useful parameter for characterizing the electro-optical effect is the half wave voltage, which is the voltage that retards one polarization relative to the other polarization by one quarter wavelength of the light being used.

Because the potassium dideuterium phosphate crystal is ferroelectric, the operating parameters of the light-valve change significantly with temperature. At room temperature (24° C.) the half-wave voltage for green light is about 3600 volts and the charge diffusion time constant of the crystal (as a consequence of ionic conductivity) is approximately 140 milliseconds. This time is too short to enable the electron beam to make a complete scan of the crystal before the charge begins to diffuse away from its deposition pixel, and therefore the light valve is inherently volatile at this temperature condition.

However, when the crystal is cooled to approximately −52° C., the dimensionless dielectric constant rises from approximately 50 to approximately 600, which a resultant change in the discharge time constant to about 40 minutes to an hour, and a change in the half-wave voltage to 300 volts. Thus, because of the ferroelectric nature of the crystal, the charge diffusion time constant of the crystal becomes approximately 40 minutes when the crystal is maintained near its Curie temperature (approximately −56° Celsius). This approximately 40 minutes-long charge diffusion time constant renders the LEP light-valve relatively "non-volatile" for its use in the present invention, because the charge storage time at each pixel on the crystal is very long compared with the time requirement of updating a scene on the crystal by changing the charge stored at each pixel. Thus, a continuous, i.e., flickerless, scene in the visible spectrum can be projected using an LEP light-valve by modulating a visible light beam passing through the crystal maintained near its Curie temperature.

When operated in the reflectance mode as shown in FIG. 2, the visible light traverses the crystal twice, so the half wave voltage is itself halved. To maintain a simple voltage-retardation relationship, it is desirable to limit the maximum retardation to 0.75 effective transmission, which requires a one-third wavelength retardation. Combined with the reflectance mode, the peak voltage requirement at green light becomes approximately 100 volts. Because the retardation is nearly independent of wavelength, the half wave voltage is higher for longer wavelengths. Operation at 800 nm requires peak voltages of 145 volts.

A convenient, stable, low-noise visible light source for modulation by the light-valve is provided by the incandescent tungsten. Using quartz-halogen technology, a filament at 3250° Kelvin will produce a radiance of 10900 mw/cm$^2$/ster in the 700 to 900 nm spectrum (chosen to minimize wavelength induced contrast degradation while maximizing radiance). As shown in FIG. 2, a Xenon light source also can be used.

A second example of a suitable non-volatile light-valve for the electron beam-addressed means is disclosed in Casasent, David, "E-Beam DKDP Light Valves," Optical Engineering, Vol. 17, No. 4, pages 344–352 (July-August 1978), which is also incorporated herein by reference.

In accordance with the present invention, reception and conversion means are provided for receiving an all-at-once, i.e., not serially written, flickerless visible light output, and converting this output into a flickerless projected infrared image. As embodied herein, the reception and conversion means includes a light transducer for receiving a flickerless, all-at-once visible light output and converting this visible light output into a flickerless infrared light signal constituting an infrared scene to be presented to a seeker. An example of such a light transducer is the so-called Bly cell disclosed in U.S. Pat. No. 4,178,514, which is incorporated herein by reference.

Figure 3:
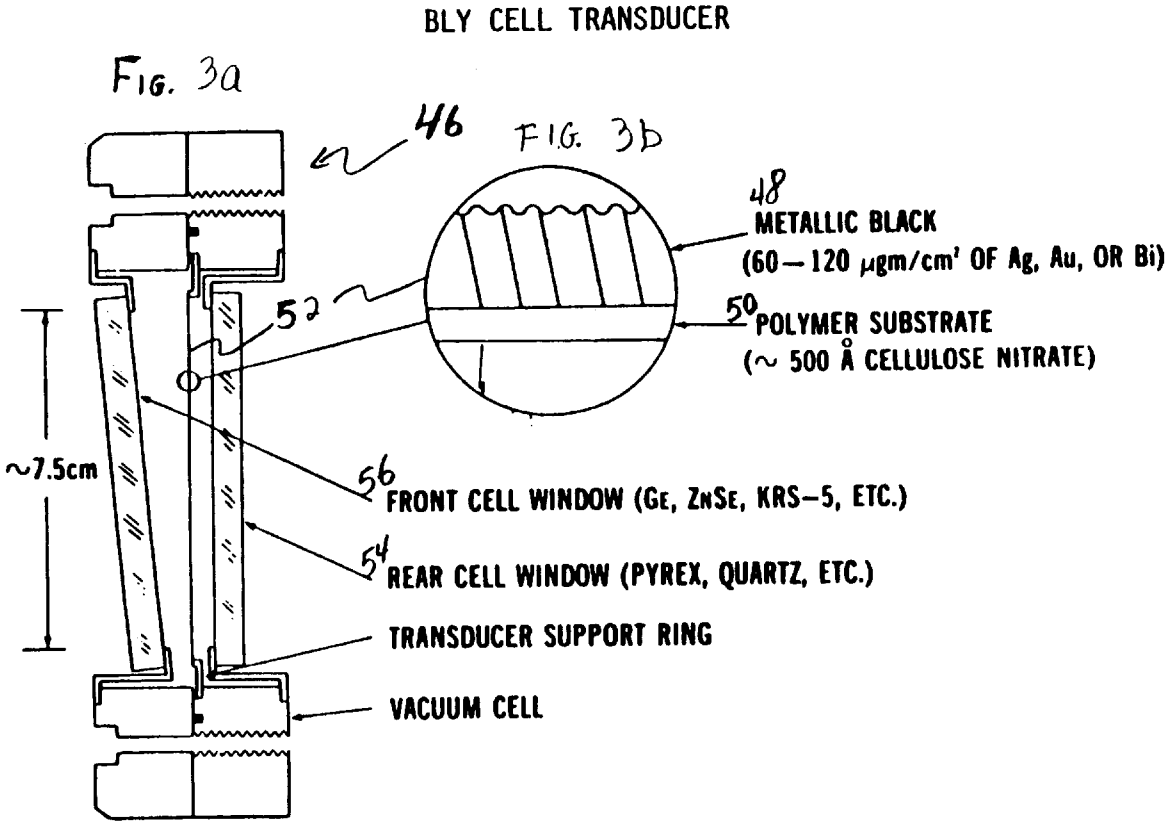
FIG. 3*a* is a side view of an embodiment of a visible-to-infrared transducer suitable for use in the present invention.
FIG. 3*b* is an enlarged view of a portion of the embodiment of FIG. 3*a*.

A Bly cell 46, such as is shown in FIG. 3, is a visible-to-infrared light transducer which approximates an infinitely thin blackbody membrane in a vacuum. As shown in FIG. 3*b*, a layer 48 of metallic black (such as gold black) having an emissivity approximating 1.00 is sputtered onto a thin, optically flat film 50 to form a blackbody membrane 52. A polymer substrate, such as an approximately 500 Angstroms thick sheet of cellulose nitrate, can serve as film 50. A visible image is projected through a rear window 54 onto film 50, as shown in FIG. 3*a*. Radiant energy of the visible image is locally absorbed by blackbody membrane 52 and reemitted from both sides of membrane 52 in the infrared spectrum. The visible light produces local heating on the membrane, and the membrane dissipates this heat by reradiating in the infrared spectrum and by lateral heat diffusion in the film. The infrared image is observed through an infrared transparent front window 56.

Lateral heat diffusion in the film of the membrane limits the resolution of the image as a function of time. If visible light is input serially to the Bly cell, shading problems will result in the infrared scene output. An "all-at-once" visible light input, as, for example, from a shuttered film projector will avoid shading.

The Bly cell is capable of simulating temperature ranges of between 35 and 50° C. with a limiting resolution of 14 cycles/mm. A five percent modulations transfer is the minimum acceptable resolution for present applications. Input power requirements for the Bly cell, exclusive of window transmission losses, are on the order of 1.7 mw/cm$^2$ per degree Celsius of simulated temperature.

Figure 4:
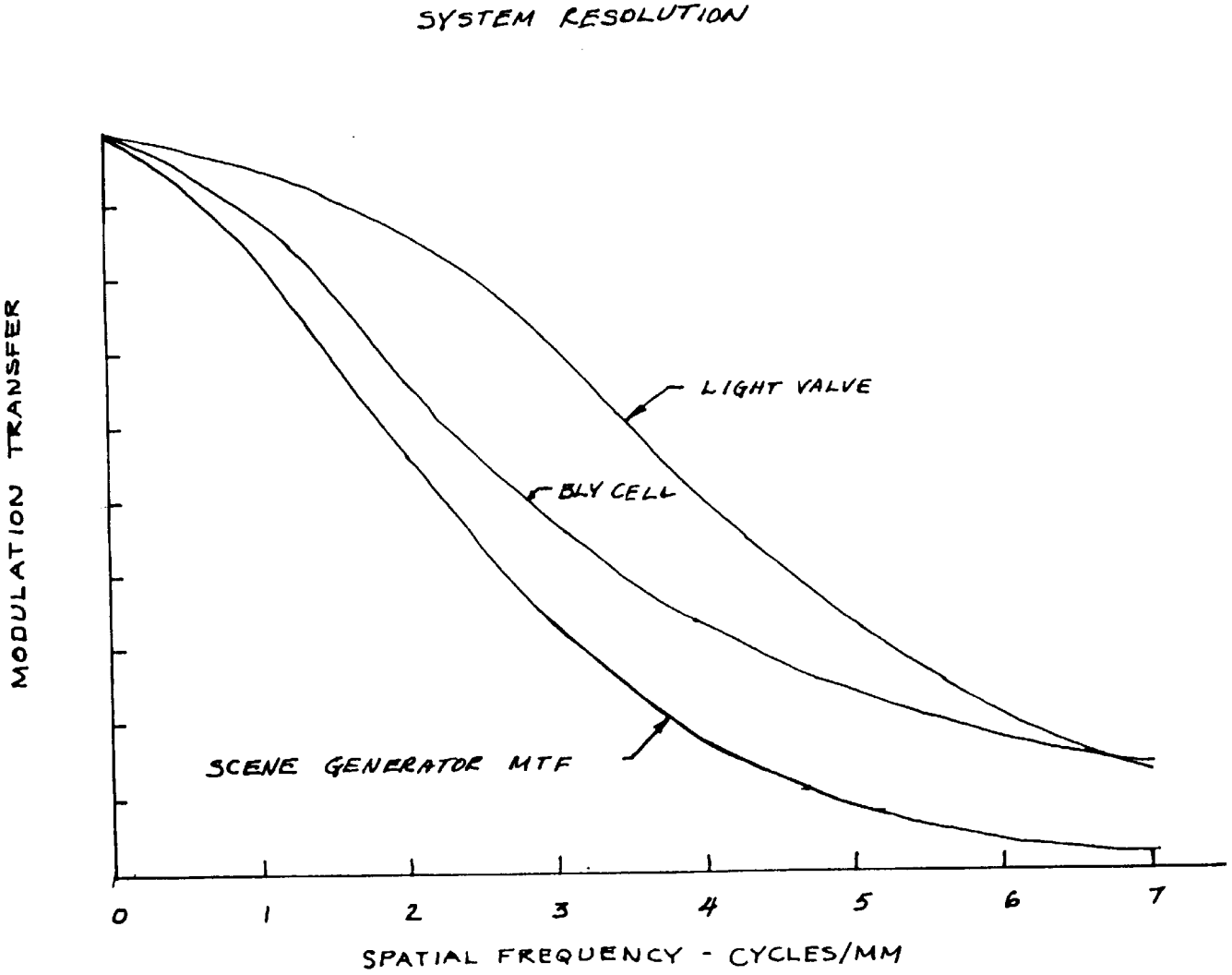
FIG. 4 illustrates the modulation transfer characteristics of an embodiment of the present invention.

A typical Bly screen format has been 5×6 cm, and the LEP light-valve is 3×4 cm. On the assumption of an equally sized format, typical transfer characteristics would be as shown in FIG. 4. The improved Bly cell Modulation Transfer Factor (MTF) is a prediction of Dr. Bly, and the e-BEAM light-valve MTF is derived from devices currently produced in France according to the LEP prescription.

First order operational parameters of the scene generator apparatus of the present invention must include the size and resolution of the light-valve, the size and resolution of the Bly cell, the intensity and stability of the light source, the uniformity, polarization constants and power handling capacity of the polarizers, and the resolution and transmission of the optics. The polarization efficiency of the light-valve and of the polarizers depends on the numerical aperture of the beam. For a source of given radiance, there is a trade-off between the power of the visible light beam incident on the crystal and the dynamic range (contrast in the image) of the modulated visible light output. For very small numerical apertures, for example, pencils of approximately 1°, contrasts of 1000:1 are possible; for larger pencils on the order of 10°, contrasts of 100:1 are expected.

Figure 5:
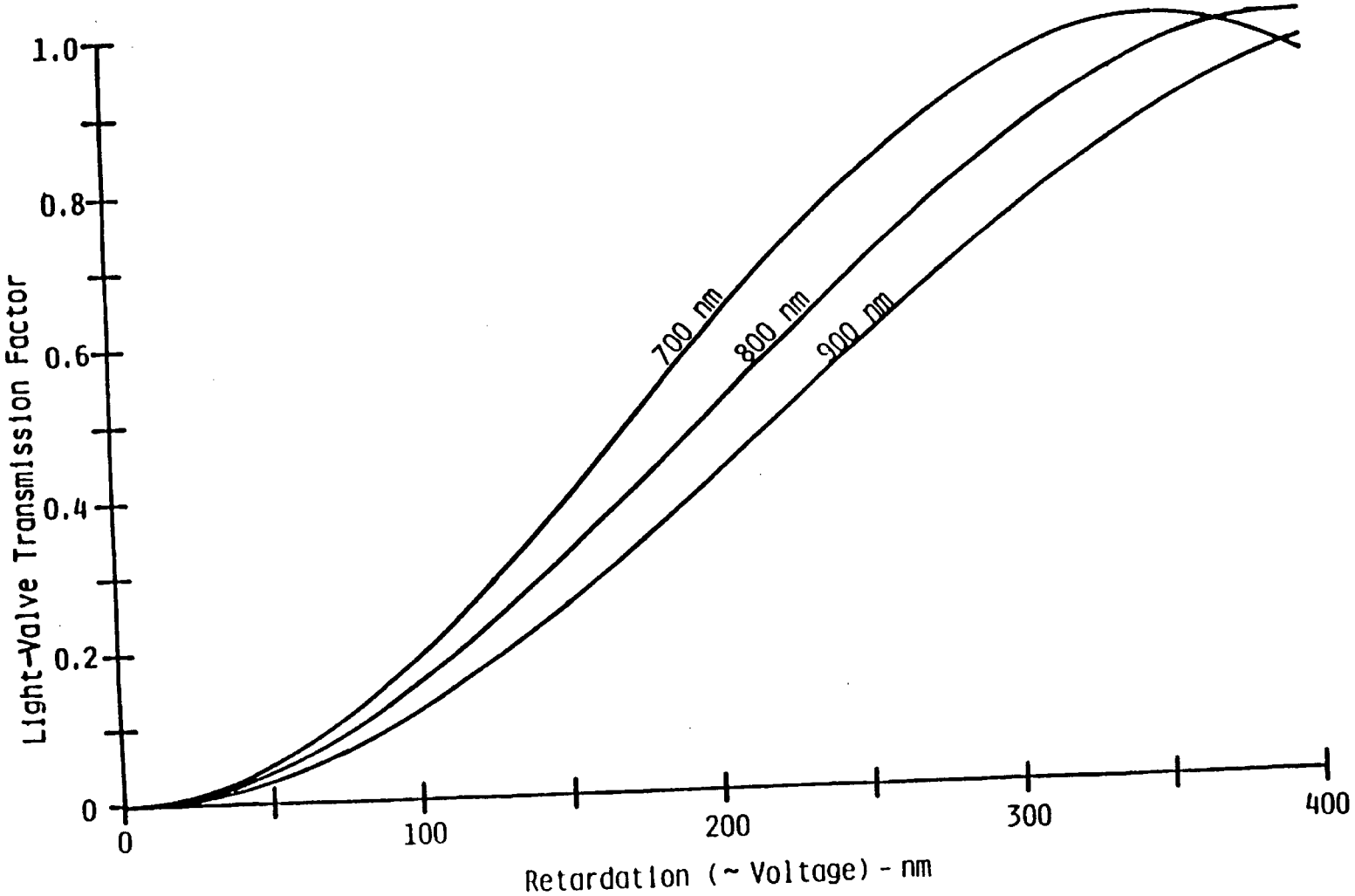
FIG. 5 illustrates the relationship between the transmission factor and the retardation voltage of a non-volatile light-valve operated at different wavelengths.

A similar effect occurs when the spectral bandwidth comprises an appreciable fraction of the mean wavelength. Because the retardation of the light by the birefringent crystal is determined by the voltage, the phase difference is inversely proportional to wavelength. This is illustrated in FIG. 5 which shows the net transmission as a function of voltage for three wavelengths.

In the embodiment shown in FIG. 1, the signal from the infrared scene signal generator can be directed to two non-volatile light-valves by means of an electron switch 58. Each non-volatile light-valve yields a flickerless, all-at-once modulated visible light signal which becomes incident upon a light transducer 60 as a flickerless, all-at-once visible light signal. Each light transducer 60 converts the all-at-once, flickerless visible light signal into a flickerless infrared light output corresponding to the infrared scene to be presented to the seeker during the test of the seeker's infrared detection system. In the embodiment having two light transducers shown in FIG. 1, each infrared light output is input to a light switch 62 which relays the infrared light output from the two transducers to the infrared relay optics.

Light switch 62 can be a mirror-chopper of the type used in some high speed movie cameras as known in the art. To approximate flickerless projection it is important that the switching occur at an intermediate image or at an image of the system stop.

As shown schematically in FIG. 1, each coordinated light-valve/Bly cell pair constitutes a separate channel for projection of an infrared image to the seeker. Signals are switched alternately from one light-valve/Bly cell channel to the other in synchronism with reflective/transmissive light switch 62 which directs the infrared output to the collimator 20. During the "off" portion of the cycle, the charge pattern on a Casasent type light-valve is erased by flooding the crystal with electrons and a new scene is written for subsequent exposure. No such erase requirement exists for the LEP light valve.

Additional sequenced operations may prove desirable to optimize performance. One such optimizing operation is blanking input illumination to the light-valve to reduce thermal loading on the valve. Another optimizing operation is radiation cooling of the Bly cell to provide a predictable initial state for the next input of modulated visible light to the cell.

By adding complexity in the form of additional infrared relay optics and further light switches, the number of channels feeding collimator 20 can be increased. One such multi-channel embodiment combines two dual channel systems by cascading the light switches. Thus four channels can be provided by synchronizing three light choppers.

It will be apparent to those skilled in the art that various additional modifications and variations could be made in the invention without departing from the scope or spirit of the invention.

What is claimed is:

1. An apparatus for producing a flickerless, constantly updated, infrared scene for closed-loop testing of a missile seeker, said apparatus comprising:

means for generating a constantly updated electrical signal corresponding to the infrared scene to be produced;

means for producing a visible light output in response to said electrical signal;

transducer means for receiving said visible light output and for converting said output into an infrared scene, the time constant of said visible light output producing means being long relative to the time constant of said transducer means, whereby a flickerless infrared scene is produced;

relay optics means for transmitting said infrared scene to said missile seeker; and means for evaluating the response of said missile seeker to said infrared scene to permit the updating of said electrical signal.

2. An apparatus as in claim 1, wherein said non-volatile, electron beam-addressed means comprises a visible light source;

a light-valve receiving light from said visible light source and producing said all-at-once visible light output, said light-valve including a ferroelectric birefringent crystal operating near its Curie temperature such that the charge diffusion time constant of said crystal becomes long enough to render said valve relatively non-volatile in the operation of said apparatus; and polarizer means for moldulating said all-at-once visible light output from said light-valve.

3. An apparatus as in claim 2 wherein said transducing means comprises a visible-to-infrared light transducer.

4. An apparatus as in claim 3 wherein said visible-to-infrared transducer comprises a Bly cell.

5. The apparatus of claim 1 wherein said visible light output producing means includes electron beam scanning means responsive to said electrical signal, a plate on which charge is deposited by electron beam scanning means to form a charge pattern, and means for converting said charge pattern to a visible light output;

and wherein the charge deposited at each point on said plate does not change until said point is addressed by said electron beam scanning means.

6. An apparatus for producing a flickerless infrared scene in response to an electrical signal representing said infrared scene, the apparatus comprising:

a non-volatile, electron beam-addressed means for producing at least two flickerless, all-at-once visible light outputs in response to said electric signal;

means for receiving each said all-at-once visible light output and for converting each said output into a respective flickerless infrared scene; and means for receiving each said flickerless infrared scene and transmitting each said scene in an alternating time sequence.

7. An apparatus as in claim 6 wherein said electron beam-addressed means comprises a visible light source;

two light-valves receiving light from said visible light source and producing said two visible light outputs, each said valve including a ferroelectric birefringent crystal operating near its Curie temperature such that the charge diffusion time constant of said crystal becomes long enough to render said valve relatively non-volatile in the operation of said apparatus;

means for alternately directing said electrical signal to each of said valves; and wherein said receiving and transmitting means includes a two-channel light-switch.

8. An apparatus for producing a flickerless, constantly updated, infrared scene for closed-loop testing of a missile seeker, said apparatus comprising:

means for generating a constantly updated electrical signal corresponding to the infrared scene to be produced;

non-volatile, electron beam-addressed means for producing a flickerless, all-at-once visible light output in response to said electrical signal;

transducer means for receiving said all-at-once visible light output and for converting said output into an infrared scene, the time constant of said visible light output producing means being long relative to the time constant of said transducer means, whereby a flickerless infrared scene is produced;

relay optics means for transmitting said flickerless infrared scene to said missile seeker; and means for evaluating the response of said seeker to said flickerless infrared scene and updating said electrical signal.

9. The apparatus of claim 8 wherein said visible light output producing means includes electron beam scanning means responsive to said electrical signal, a plate on which charge is deposited by electron beam scanning means to form a charge pattern, and means for converting said charge pattern to a visible light output;

and wherein the charge deposited at each point on said plate does not change until said point is addressed by said electron beam scanning means.

10. A method for projecting a flickerless, constantly updated, infrared scene for closed-loop testing of a missile seeker, the method comprising the steps of:

generating constantly updated electrical signals representing said scene;

producing in response to said electrical signals a flickerless, all-at-once visible light output;

receiving and converting by means of a transducer said visible light output into a flickerless projected infrared scene, the time constant of said visible light output being long relative to the time constant of said transducer;

transmitting by means of relay optics said infrared scene to said missile seeker; and evaluating the response of said missile seeker to said infrared scene and updating said electrical signals.

11. A method as in claim 10 wherein the step of producing a flickerless, all-at-once visible light output includes the step of operating a light-valve having a ferroelectric birefringent crystal near its Curie temperature to ensure that the charge diffusion time constant of said crystal becomes long enough to render said valve relatively non-volatile during the operation of said method.

12. A method for projecting a flickerless infrared scene comprising the steps of:

alternately directing an electrical signal to each of two non-volatile, electron beam-addressed means;

producing a flickerless, all-at-once visible light output from each said electron beam-addressed means; and converting each said all-at-once visible light output into a different flickerless projected infrared scene.

13. A method as in claim 12 including the step of projecting each said different all-at-once infrared scene in an alternating time sequence.

14. A method as in claim 12 wherein the step of alternately directing an electron beam includes operating a light-valve having ferroelectric birefringent crystal near its Curie temperature to ensure that the charge diffusion time constant of said crystal becomes long enough to render said crystal relatively non-volatile in the operation of said method; and wherein said method includes the further step of directing each said infrared scene to a two-channel light-switch which alternately projects each said flickerless infrared scene.